United States Patent [19]

Uhlig

[11] Patent Number: 4,494,347

[45] Date of Patent: Jan. 22, 1985

[54] METHOD AND ASSEMBLY FOR FASTENING FACADE PANELS OR FACADE SUPPORTS IN SPACED RELATION TO A SUPPORT SURFACE

[75] Inventor: Raimer Uhlig, Munich, Fed. Rep. of Germany

[73] Assignee: Hilti Aktiengesellschaft, Fed. Rep. of Germany

[21] Appl. No.: 426,638

[22] Filed: Sep. 29, 1982

[30] Foreign Application Priority Data

Oct. 14, 1981 [DE] Fed. Rep. of Germany ..... 3140861

[51] Int. Cl.[3] ..... E04B 1/38

[52] U.S. Cl. ..... 52/508; 411/44

[58] Field of Search ..... 52/508; 403/167, 252; 248/205 B; 411/45, 44, 49

[56] References Cited

U.S. PATENT DOCUMENTS 3,471,183 10/1969 Fischer ..... 52/508 X
4,050,346 9/1977 Fischer ..... 411/44
4,182,091 1/1980 Fischer ..... 52/508
4,238,987 12/1980 Siebrecht-Reuter ..... 52/508 X

FOREIGN PATENT DOCUMENTS 1015688 1/1966 United Kingdom ..... 52/508
2077877 12/1981 United Kingdom ..... 411/49

*Primary Examiner*—J. Karl Bell
*Attorney, Agent, or Firm*—Toren, McGeady and Stanger

[57] ABSTRACT

An assembly is used to space facade panels and/or facade supports from a structural support member and the assembly is made up of a support member, a dowel and an expansion screw. The support member is resilient and is provided with stop shoulders so that it can be inserted into an opening in the facade panel or facade support with the shoulders bearing against the panel or support. A dowel is inserted through and is interengaged with the support member. The dowel is inserted into a borehole in the structural support member and the expansion screw secures the dowel within the borehole.

9 Claims, 5 Drawing Figures

Fig. 1
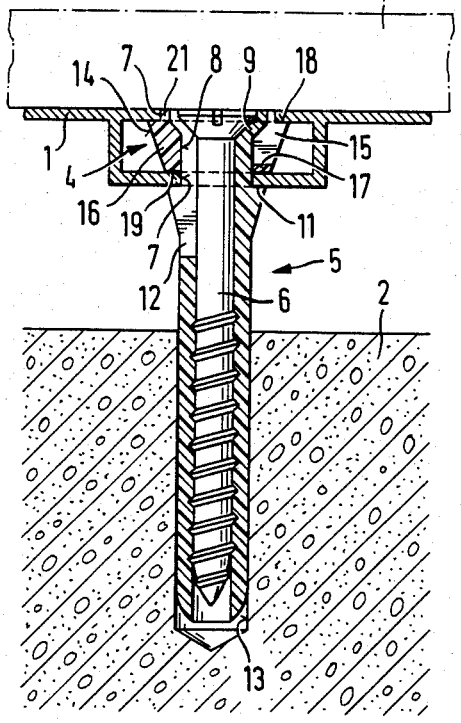
Fig. 2
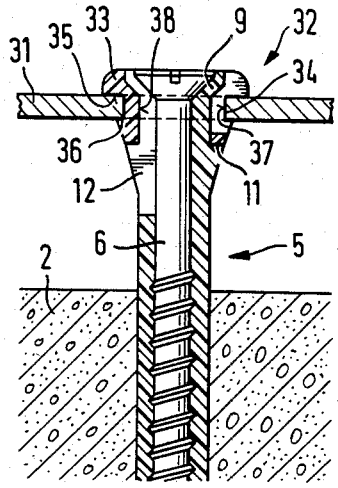
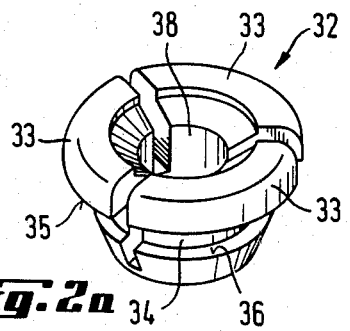
Fig. 2a
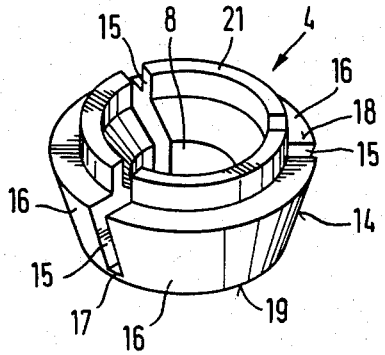
Fig. 1a
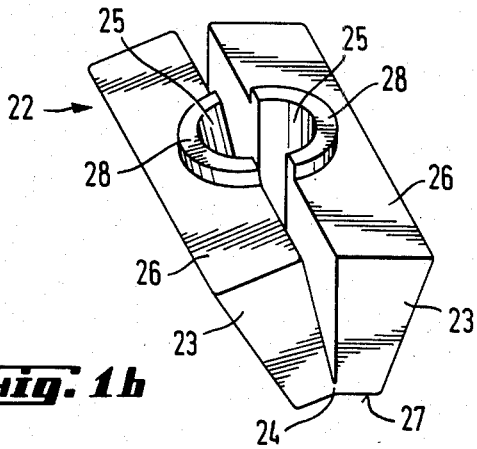
Fig. 1b

METHOD AND ASSEMBLY FOR FASTENING FACADE PANELS OR FACADE SUPPORTS IN SPACED RELATION TO A SUPPORT SURFACE

SUMMARY OF THE INVENTION

The present invention is directed to a method of fastening facade panels and/or facade supports in spaced relation to a structural support member and to the assembly used in effecting the fastening. The assembly used for securing the facade panel or facade support is made up of a support member which can be secured in an opening in the facade panel or facade support. In addition, the assembly includes a dowel insertable into the structural support member.

For securing facade panels or facade supports in spaced relation to a structural support, a fastening arrangement employing dowels is disclosed in German Offenlegungsschrift 27 12 670. The rear section of an expansion screw projects outwardly from the dowel which is secured in the structural support member and the facade panel is secured onto the rear section. The rear section projects through the facade panel and the panel is secured at the expansion screw head by a support member located in an opening through the facade panel.

A considerable disadvantage of this arrangement is that the proper spacing between the facade panel and facade support and the structural support member cannot be adjusted. As a result, the dowel experiences various anchoring conditions, such as the diameter ratio of the dowel to the receiving borehole in the structural support member and the strength of the structural support member. Therefore, the expansion screw must be threaded into the dowel at varying depths to achieve adequate anchoring. As a result, the screw heads which holds the facade panels or the facade supports at a distance from the structural support member and thus the final position of the screw heads end up at different distances from the structural support member.

Another fastening arrangement is known, however, it is suitable only for the spaced fastening of relatively thick-walled facade supports. In such an arrangement a dowel is used made up of a forward anchoring section and a rearward retaining section for the facade support. The dowel projects into an opening in the facade support and has annular shoulders for bracing the facade support. After the correct assembly distance between the facade support and the structural support member is set, which is achieved by inserting the forward anchoring section more or less deeply into the receiving bore in the structural support, an expansion screw is threaded into the tubular dowel to provide the anchoring effect. This arrangement has the disadvantage that high specific loads are developed. Consequently, the contact areas of the dowel and the facade support may be overstressed and the attachment may fail. For the same reasons, this fastening arrangement is unsuitable for facade panels and facade supports formed of thin-walled hollow sections.

Therefore, it is the primary object of the present invention to provide a method for effecting the variably spaced fastening of thin-walled facade panels and facade supports.

In accordance with the present invention, initially a support member is secured in an opening in the facade panel or facade support. Subsequently, a dowel is interengaged with the support member and then the dowel is anchored into the structural support member.

The insertion of a support member into the opening in a facade panel or a facade support with the retaining section of a dowel inserted into the support member, permits the adaptation of the fastening arrangement to thin-walled facade panels and facade supports, since the support members can be designed for different wall thicknesses and section standards of the facade panels or facade supports.

After the dowel is interengaged with the support member, it is anchored in a conventional manner into the structural support member. For the sake of simplicity, an essentially tubular dowel having an anchoring section can be fixed in a receiving borehole formed in the structural support member by threading an expansion screw into the dowel. Before the anchoring step is carried out, the desired distance between the facade panel or the facade support and the structural support member is established.

In carrying out the method of the present invention, a support member is proposed with supporting sides forming stop shoulders for engaging the facade panel or the facade support.

The stop shoulders bear against the surface of the facade or the facade support in the region around the opening through the panel or support. The support member is formed as a hollow cylindrical member for use in round openings with the stop shoulders having an annular shape. If the opening is in the form of a longitudinal slot, as is the case particularly in hollow facade supports, basically rectangular parallelepiped support elements with strip-shaped stop shoulders are suitable.

Preferably, the stop shoulders are formed by two end faces on the support member. Particularly in hollow section facade supports, a secured, form-locking engagement of the support member in the hollow space can be achieved with the stop shoulders bearing against oppositely located web surfaces of the hollow section.

If, however, the problem is one of holding thin-walled facade panels or sheet metal facade supports, then the stop shoulders are advantageously formed by the opposite flanks of a circumferential groove.

To facilitate insertion of the support member into an opening, the member is advantageously formed of a plastic material so that it is radially resilient with such resiliency being provided by axially extending slots in a hollow or annular cylindrically shaped support member.

In another embodiment of the present invention, the stop shoulder on one supporting side is arranged in a radially resilient segment of the support member. Such an arrangement facilitates the insertion of the support member into the opening of the facade panel or the facade support. During the insertion operation, the resilient segments move elastically inwardly toward one another so that the stop shoulders can be pushed through the opening without any difficulty. Once the second stop shoulder has passed through the opening in the insertion direction, the segments move elastically apart from one another and an engagement of the stop shoulders on the resilient segments is effected within the facade support which is formed as a hollow section.

Another advantageous arrangement is provided for positioning the support member if it is formed with a stop for affording guidance and a secure attachment within the facade panel or the facade support. In hollow sectioned facade supports, such a stop can project into the opening after the support member is inserted so that it provides protection against displacement. Accordingly, the support member maintains, independently of the insertion position of the fastening member, its correct functional position relative to the opening.

Another feature of the present invention is the locking interengagement between the support member and the dowel. For the sake of simplicity, the locking arrangement can be provided on the dowel by a circular, sharp-edged flange. The support member is correspondingly formed with a groove having a shape similar to that of the flange. A more effective locking engagement is afforded, however, by means of two annular shoulders arranged in axially spaced relation on the neck section of the dowel with at least one of the annular shoulders resting against the support member.

To protect the head of the expansion screw particularly against corrosion, a cover-shaped cap is placed over the support member after the completion of the fastening connection. Preferably, the cap is formed of plastic material.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 1 is an axially extending section view of a thin-walled hollow section facade support secured by a fastening arrangement to a structural support member embodying the present invention;

FIG. 1*a* is an enlarged perspective view of a support member used in the fastening arrangement illustrated in FIG. 1;

FIG. 1*b* is an enlarged perspective view of a support member suitable for use in thin-walled hollow sections having a longitudinal slot;

FIG. 2 is an axially extending sectional view of a fastening arrangement securing a thin-walled facade panel to a structural support member; and FIG. 2*a* is an enlargeed perspective view of the support member used in the fastening arrangement displayed in FIG. 2.

DETAIL DESCRIPTION OF THE INVENTION

In FIG. 1 a facade support 1 is secured to and is spaced outwardly from a structural support member 2. Facade support 1 serves to support and hold a facade panel 3, shown in phantom, connected to the facade support by an adhesive, screws or rivets, not shown. To secure the facade support in position a fastening assembly is used including a support member 4, a dowel 5 and an expansion screw 6 for anchoring the dowel in a borehole drilled in the structural support member 2.

In the operation of mounting the facade support 1 on the structural support member 2, initially the support member 4 is inserted into an opening 7 in the facade support. The facade support has several such openings 7 and a support member 4 can be inserted into each of such openings. The support member has an annular shape providing a bore 8 through which the dowel 5 can be subsequently inserted. When the dowel is inserted it is locked into the bore 8 in the support member by a pair of annular shoulders 9, 11 spaced apart in the axial direction of the dowel and the support member. With the dowel locked to the support member it is also secured to the facade support 1. To facilitate the passage of the annular shoulder 11 through the bore 8 in the support member 4 and through the opening 7 in the facade support 1, the trailing end of the dowel, that is the end spaced outwardly from the structural support member 2 as viewed in FIG. 1, is provided with axially extending slots 12 spaced apart about the dowel axis. These slots 12 divide the trailing end portion of the dowel 5 into radially resilient segments. The annular shoulders 9 and 11 are located in the axial range of the slots 12. Accordingly, the segments move radially inwardly when the dowel is inserted through the bore 8 in the support member 4. When the support member 4 and the dowel 5 are assembled in the facade support 1, the dowel is inserted into the borehole 13 prepared in the structural support member 2 so that the proper spaced relation between the facade support and the structural support member is established. As a result, the leading end of the dowel 5 is inserted more or less deeply into the receiving borehole 13 in the structural support member 2. Subsequently, the expansion screw 6 is inserted into and threaded through the dowel so that the dowel is anchored within the structural support member 2 in a known manner.

As shown in FIG. 1, the support member 4 is annular and its outside surface is frusto-conical, note FIG. 1*a*. The frusto-conical surface 14 of the support member 4 is adjusted to the inside cross-section of the opening 7 into the hollow interior of the facade support 1. Axially extending slots are provided in the support member 4 extending from its trailing end to adjacent its leading end. The slots 15 divide the support member into segments 16 interconnected at the leading end of the member by webs 17. Due to the slots 15, the support member 4 is radially resilient during the insertion operation. The support member 4 has a pair of axially spaced apart annular stop shoulders 18,19 formed in the opposite end faces, that is, the faces extending transversely of the axial direction of the support member. When the support member 4 is inserted within the hollow section of the facade support 1, initially the segments 16 move radially inwardly and then, with the shoulders 18 and 19 flush with the inside surfaces of the hollow space, the segments rebound radially outwardly until the stop shoulders 18 and 19 bear against the inside surfaces within the hollow space in the facade support 1. As can be seen in FIG. 1*a*, an annular stop 21 projects axially upwardly from the stop shoulder 18 and it extends through the opening 7 when the support member 4 is inserted in interengaging contact with the inside surfaces of the hollow space in the facade support 1. The annular stop 21 holds the support member 4 within the opening 7 in the facade support.

Frequently, it is necessary to displace the attachment location of the facade support 1 to the structural support member 2. To provide such displaceability, hollow section facade supports 1 are used with a slot-shaped opening 7 into the hollow space within the facade support, instead of the round openings shown in FIG. 1. In such an arrangement, a rectangular parallelepiped support member 22 is used as illustrated in FIG. 1*b*. Support member 22 is made up of two segments 23 interconnected by a web 24 along the leading side of the support member. A bore 25 is formed through both of the segments 23 so that the dowel can be inserted through the support member. Stop shoulders 26, 27 are provided on the leading and trailing sides of the support member so that they can bear against the inside surfaces of the hollow space within the facade support 1. An annular stop 26 extends upwardly from the trailing stop shoulder 26 and projects into the slot-shaped opening 7.

In FIG. 2 a thin-walled facade panel 31 is shown secured in spaced relation to the surface of a structural support member 2. The spaced attachment of the facade panel 31 is effected by a support member 32 and a dowel 5 similar to the arrangement shown in FIG. 1.

In FIG. 2*a* the support member 32 is shown in perspective and it is formed by a plurality of individual segments 33 connected together by webs so that the segments are radially resilient. A circular circumferential groove 34 is provided in the exterior frusto-conical surface of the support member 32. The groove 34 has a pair of stop shoulders 35, 36 spaced apart in the axial direction of the support member. These stop shoulders 35, 36, as can be seen in FIG. 2, bear against the opposite face surfaces of the facade support 31 around the circular opening 37. The interengagement of the face surfaces of the facade support 31 and the stop shoulders 35, 36 of the support member 32 secure the two parts together. Support member 32 has an axially extending bore or opening 38 in which the dowel 5 can be secured. When the dowel 5 is inserted into the bore 38 it is held in locking engagement by the support member 32 so that it cannot be axially displaced. The dowel 5 is formed of radially resilient segments on which the annular shoulders 9, 11 are provided which serve to interengage corresponding surfaces on the support member 32 for holding the dowel in place. With the support member 32 and the dowel 5 secured to the facade plate 31, the proper spacing between the plate and the surface of the structural support member 2 can be established with the dowel extending into the borehole in the structural support member. An expansion screw 6 is then threaded into the dowel for securing it in position within the borehole in the structural support member 2.

While specific embodiments of the invention have been shown and described in detail to illustrate the application of the inventive principles, it will be understood that the invention may be embodied otherwise without departing from such principles.

I claim:

1. A method of assembling facade members in spaced relation to a structural support using a dowel which can be anchored into the structural support and a support member which can be secured in an opening in the facade member, comprising the steps of inserting the support member into the opening in the facade member, insterengaging the support member within the opening in the facade member so that the support member is secured against displacement relative to the facade member, inserting the dowel through the support member and interengaging the dowel and the support member so that the dowel is secured against displacement relative to the support member, inserting the dowel secured to the support member and the facade member into a prepared borehole in the structural support and then anchoring the dowel within the borehole in the structural support.

2. An assembly for mounting facade members in spaced relation to a structural support, said assembly comprising an axially extending support member having a pair of stop shoulders spaced apart in and extending transversely of the axial direction of said support member and arranged to bear against the facade member for securing said support member to the facade member, said support member having a bore extending axially therethrough, an axially extending dowel insertable through said bore in said support member, first and second engaging means on said support member and said dowel for securing said dowel within the bore in said support member, and said first and second engaging means spaced apart in the axial direction of said dowel.

3. An assembly, as set forth in claim 2, wherein said support member has a pair of oppositely facing end faces extending transversely of the axial direction thereof, and said end faces forming said stop shoulders.

4. An assembly, as set forth in claim 2, wherein said support member has a circumferentially extending annular groove formed in the outside surface thereof, said groove having a pair of opposite flanks extending transversely of the axial direction of said support member and said flanks face one another and form said stop shoulders.

5. An assembly, as set forth in claim 2, 3 or 4, wherein said support member has a number of angularly spaced axially extending slots from one transverse end thereof to a location adjacent to but spaced from the other transverse end and said slots divide said support member into a plurality of radially resilient interconnected segments, and at least one of said stop shoulders is formed in said radially resilient segments.

6. An assembly, as set forth in claim 2, 3 or 4, wherein an annular shaped stop extends axially outwardly from one end face of said support member and is arranged to engage an opening through the facade member support for securing said support member in position.

7. An assembly, as set forth in claim 2, wherein axially extending slots are formed in said dowel in the region thereof secured within said support member and said slots divide said dowel into a number of radially resilient segments, and said first and second engaging means comprises a pair of axially spaced annular shoulders formed on the radially resilient segments of said dowel and corresponding surfaces formed on said support member for effecting the locking engagement between said dowel member and said support member.

8. An assembly, as set forth in claim 2, 3 or 4, wherein said support member has a frusto-conically shaped outside surface.

9. An assembly, as set forth in claim 2, 3 or 4, wherein said support member has the shape of a rectangular parallelepiped tranversely of the axial direction thereof.

* * * * *